United States Patent [19]

Eitel

[11] Patent Number: 4,763,619

[45] Date of Patent: Aug. 16, 1988

[54] MULTICYLINDER INTERNAL COMBUSTION ENGINE UTILIZING SPLIT BLOCK WITH UNITIZED CYLINDER HEAD AND LINER

[76] Inventor: Jay M. Eitel, 130 Selby La., Atherton, Calif. 94025

[21] Appl. No.: 34,220

[22] Filed: Apr. 2, 1987

[51] Int. Cl.[4] ..... F02F 1/00

[52] U.S. Cl. ..... 123/193 CH; 123/193 C; 123/55 A; 123/56 AC

[58] Field of Search ..... 123/193 C, 193 CH, 193 A, 123/41.83, 41.84, 41.74, 195 S, 195 A, 56 AC, 55 A

[56] References Cited

U.S. PATENT DOCUMENTS 1,401,294 12/1921 Wall ..... 123/193 CH 4,230,087 10/1980 Abe et al. ..... 123/193 CH 4,699,100 10/1987 Leydorf et al. ..... 123/193 CH

*Primary Examiner*—Willis R. Wolfe

*Assistant Examiner*—M. Macy

*Attorney, Agent, or Firm*—Flehr, Hohbach, Test, Albritton & Herbert

[57] ABSTRACT

Multicylinder internal combustion engine of the type having a crankshaft and a block comprised of first and second mating half sections joined in a common plane which passes through and along the axis of the crankshaft. The half sections provides a crankcase crankshaft bearing support and cylinder portions. A unitized cylinder head and sleeve construction is provided. A cooperative securing mechanism is provided for securing the unitized cylinder head and sleeve construction to the engine block.

9 Claims, 5 Drawing Sheets

MULTICYLINDER INTERNAL COMBUSTION ENGINE UTILIZING SPLIT BLOCK WITH UNITIZED CYLINDER HEAD AND LINER

This invention relates to a multicylinder internal combustion engine utilizing a split block and crankcase with a unitized cylinder head and liner, and more particularly to such an internal combustion engine utilizing multiple cylinders in which the block is formed in two half sections joined in a common plane which passes through and along the axis of the crankshaft and in which the two half sections comprise a unitized cylinder head and liner.

Internal combustion engines have been proposed such as disclosed in U.S. Pat. No. 2,491,630 in which the block is vertically split. FIGS. 1 and 2 in that patent illustrate the formation of an assembly of cylinder sections along a vertical plane perpendicular to the axis of the crankshaft of the engine. However, in another version in FIG. 5 of that patent it is disclosed that it may be preferable from a production assembly standpoint to split the engine in a vertical plane that passes through and along the axis of the crankshaft. Such engines, however, heretofore have not been accepted and the common practice at the present time is still to fabricate the block for the cylinders and the crankcase from one unitized casting which includes the water jackets and in some cases, oil passages, etc. With the requirements mandated by the United States government, it has been necessary for manufacturers of internal combustion engines to downsize the engines and to obtain more horsepower per pound of engine weight. This has necessitated halting most of the manufacture of V-8 type engines and to return to four cylinder in-line engines. In order to obtain greater horsepower from such smaller four cylinder engines, there has been increased heat dissipation requirements placed on such engines which has increased exhaust valve seat and head gasket failures. Also in such designs, there has been inadequate coolant space for the exhaust and intake valves. There is therefore a need for a new and improved internal combustion engine construction which will overcome these difficulties.

In general, it is an object of the present invention to provide a multicylinder internal combustion engine which utilizes a split block which is split along a line parallel to and extending through the axis of the crankshaft.

Another object of the invention is to provide an engine of the above character which utilizes a unitized cylinder head and liner.

Another object of the invention is to provide an engine of the above character which facilitates attachment of the cylinder head to the engine block.

Another object of the invention is to provide an engine of the above character in having improved cooling capabilities, particularly in the vicinity of the exhaust valve.

Another object of the invention is to provide an engine of the above character in which increased space is made available for exhaust and intake valves.

Another object of the invention is to provide an engine of the above character in which the cylinder head gasket is eliminated.

Another object of the invention is to provide an engine of the above character which makes it possible to eliminate cylinder head attachment bolts.

Another object of the invention is to provide an engine of the above character which has an adequate water jacket for cooling of the engine.

Another object of the invention is to provide an engine of the above character which can be utilized in conjunction with radial engines.

Another object of the invention is to provide an engine of the above character which can be utilized in conjunction with a multi-cylinder opposed engine suitable for use in airplanes.

Another object of the invention is to provide an engine of the above character which can be readily assembled and disassembled.

Another object of the invention is to provide an engine of the above character which can be constructed from conventional materials.

Additional objects and features of the invention will appear from the following description in which the preferred embodiments are set forth in detail in conjunction with the accompanying drawings.

Figure 1:
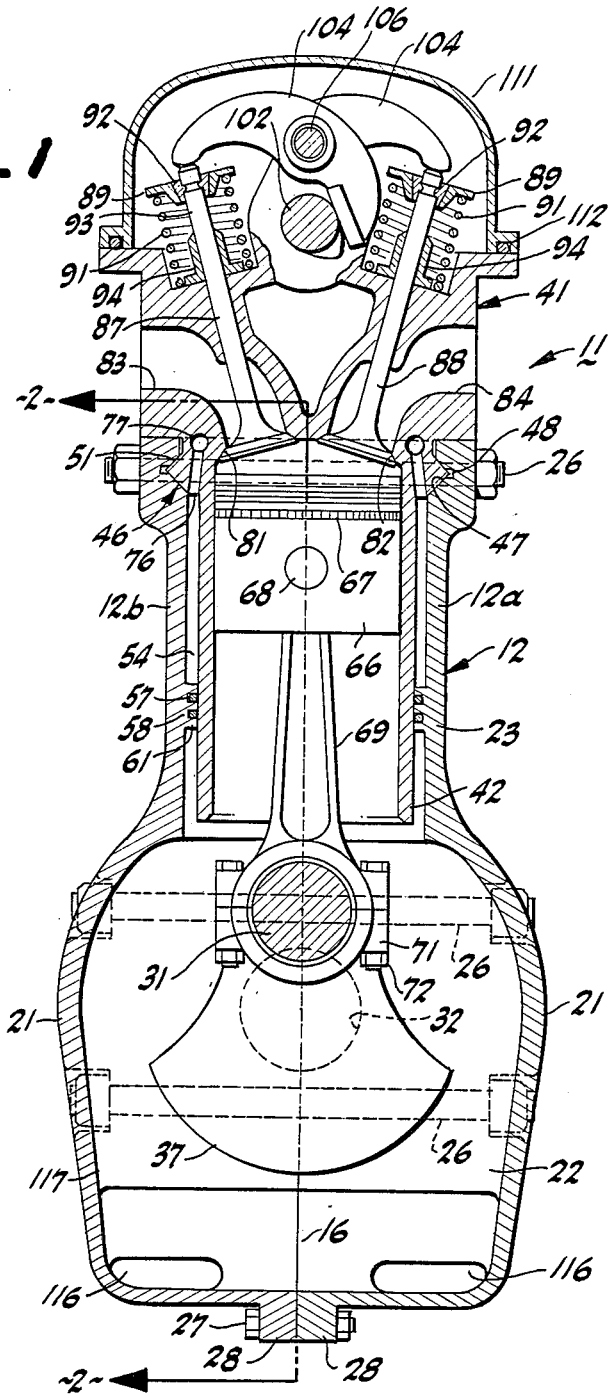
FIG. 1 is a cross-sectional view taken along the line 1—1 of FIG. 2 and showing an internal combustion engine incorporating the present invention.

In general, the internal combustion engine of the present invention utilizes a crankshaft and is comprised of a block having first and second mating half sections which are joined in a common plane which passes through and along the axis of the crankshaft. The half sections provide crankcase, crankshaft bearing support and cylinder portions. A unitized cylinder head and liner is provided. Cooperative securing means is carried by the cylinder head and the block for securing the cylinder head to the block which does not require the use of a head gasket.

More particularly, as shown in the drawings, the internal combustion engine 11 of the present invention is comprised of a block or assembly 12 which is formed of two half sections **12*a* and 12*b* which are joined together as hereinafter described along a common plane 16 which passes through and extends along the axis of the crankshaft for the internal combustion engine. The half sections 12*a* and 12*b* are formed of a suitable material such as cast iron, cast steel or aluminum. As shown particularly in FIGS. 1 and 2, each of the half sections 12*a* and 12*b* is provided with a crankshaft portion 22, a crankcase bearing support portion 22 and a cylinder water jacket portion 23**.

Suitable means is provided for fastening the two half sections, **12*a* and 12*b* together to form a unitary assembly and consists of tie bolts 26 arranged in three rows. One row extends between the two half sections 12*a* and 12*b*** below the crankcase bearing support portion and another row above the crankshaft bearing support portion. The third row is at the upper extremity of the sections 12*a* and 12*b*. Additional bolts 27 are provided for fastening the flanges 28 provided on the half sections 12*a* and 12*b*.

A crankshaft 31 is mounted in the block 12 and is rotatably mounted in bearings 32 carried by the crankcase bearing support portions 22. Conventional lip seals 33 are provided in the outer extremities of the block 12 and seated in the half section 12*a* and 12*b*. Output flanges 36 are provided on the outer extremities of the crankshaft 31. The crankshaft 31 is provided with interconecting webs or cheeks 37.

A unitized cylinder head 41 with an integral cylinder liner or barrel 42 is provided. The unitized cylinder head and cylinder liner can be formed of the same materials as the block 12.

Cooperative securing or clamping means 46 is provided for securing the unitized head 41 and cylinder liner 42 to the upper extremities of the half sections 12*a* and 12*b* of the block 12 so as to make possible the elimination of a head gasket. Such cooperative clamping means 46 includes a V-shaped recess 47 which is formed in a suitable manner such as by machining the upper portion of the half sections 12*a* and 12*b*. The V-shaped recess 47 opens into an imaginery cylindrical surface which is concentric with the axis of the cylinder liner 42. An additional recess 48 which is generally rectangular in cross section is formed in the apex of the V-shaped recess 47 and is adapted to receive an O-ring (not shown).

The securing or clamping means 46 also includes a V-shaped flange or protrusion 51 which can be formed by suitable means such as by machining on the unitary cylinder head 41 and the cylinder liner 42. The V-shaped flange 51 is adapted to extend into the V-shaped recess 47 as shown particularly in FIG. 1. As also can be seen, the V-shaped recess 47 opens into an imaginery cylindrical surface which is concentric with the axis of the associated cylinder portions 23 of the half sections 12*a* and 12*b*. Similarly, the flange or protrusion 51 extends through the same imaginery cylindrical surface. When the V-shaped flange 51 is seated within the V-shaped recess 47 and the O-ring (not shown) in the recess 48 is engaged, the tie bolts 26 can be inserted and tightened to establish a watertight seal between the unitized cylinder head and the cylinder liner 42 and the block 12 comprised of the half sections 12*a* and 12*b*. Means is provided for circulating water or other cooling liquid around the cylinder liner or barrel 42 and consists of an annular space 54 which is sealed off from the crankcase 21 by suitable means such as a pair of spaced apart O-rings 57 and 58 which are seated in rectangular recesses 59 provided in ribs 61 formed integral with the cylinder portions 23 of the half sections 12*a* and 12*b*. These o-rings 57 and 58 are adapted to engage the lower extremity of the cylinder liner 42 to form a liquid-tight seal with respect to the cylinder liner.

A piston 66 of a conventional type is mounted for reciprocating movement in each of the liners or barrels 42 and is provided with conventional piston rings 67 of a conventional type which is adapted to form a sealing engagement between the piston 66 and the interior surface of the liner 42. The piston 66 is connected by a wrist pin 68 to a connecting rod 69. The connecting rod 69 is connected to the crankshaft 31 by caps 71 which are seated on the crankshaft 31 and secured thereto by bolts 72 extending through the connecting rod 69 and the cap 71.

The annular space 54 which serves as a water jacket for the liner 42 is in communication with a plurality of holes 76 which are in communication with the annular space 54 and extend upwardly through the lower extremity of the cylinder head 41 and are in communication with laterally extending holes 77.

The cylinder head 41 is provided with at least one intake valve seat 81 and an exhaust valve seat 82 which open downwardly into the upper extremity of the dome-shaped cylindrical space 86 which overlies the top of the piston 66. The seats 81 and 82 are in communication with intake and exhaust flow passages 83 and 84 provided in the cylinder head 41. An intake valve 87 and an exhaust valve 88 are mounted for reciprocating movement within the cylinder head 41 and are adapted to seat in the intake and exhaust valve seats 81 and 82 so that they can be moved between open and closed positions with respect to the same. Means is provided for retaining the intake valve 87 and the exhaust valve 88 in a closed positions and consists of a valve spring retainer 89 having its outer margin engaged by a coil spring 91 and having its inner margin engaging a valve lock 92 which engages the stem of the associated intake or exhaust valve 87 or 88. The other end of the spring 91 seats against the cylinder head 41 and circumscribes a valve stem guide 94 also seated on the head.

Means is provided for moving the intake valve 87 and the exhaust valve 88 towards open positions against the force of the coil springs 91 and consists of an overhead cam shaft 102 which is rotated in a predetermined relationship with the rotation of the crankshaft 31. The overhead cam shaft 103 is provided with cam lobes 103 which are adapted to engage rocker arms 104 that are pivotally mounted upon a rocker arm shaft 106. The rocker arms 104 are adapted to engage the outer extremities of the stems 93 of the intake valves 87 and the exhaust valve 88 as shown particularly in FIG. 2. Other means of value actuation (not shown) can be used such as camshaft located in block with conventional tappets, push rods and rocker arms. Also dual camshafts can be utilized if desired.

A spark plug hole 88 is provided in the cylinder head 41 and is adapted to receive a spark plug (not shown). A valve cover 111 of a suitable material such as of sheet metal is provided to cover the intake and exhaust valves 87 and 88 and their associated structures. In order to provide a suitable liquid-tight seal, an O-ring 112 can be provided for ensuring that a liquid-tight seal is formed between the valve cover 111 and the upper extremity of the cylinder head 41.

Means is provided to ensure that there is adequate oil flow within the crankcase and consists of a plurality of holes 116 provided in the transversely extending webs 117.

Figure 2:
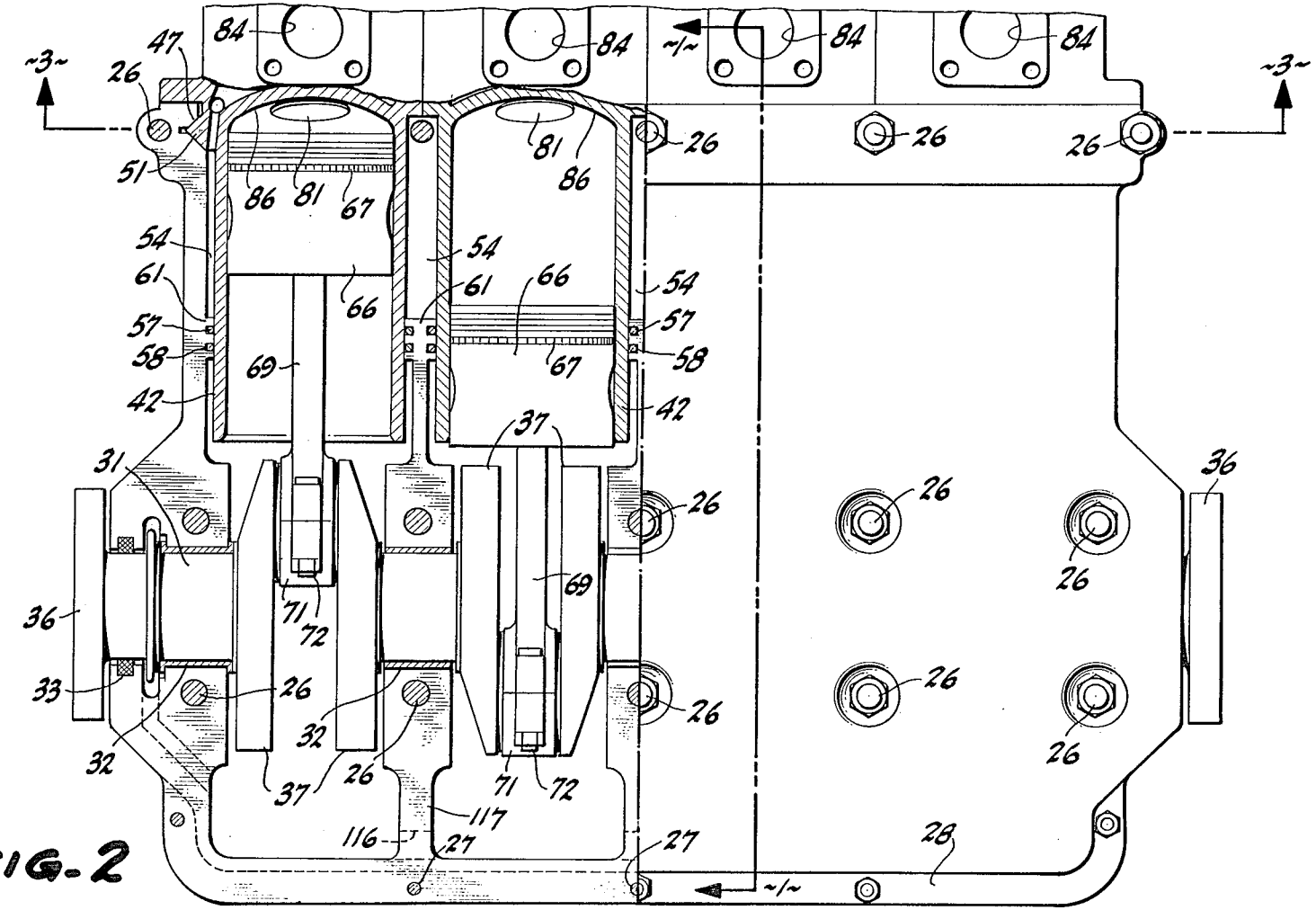
FIG. 2 is a cross-sectional view taken along the line 2—2 of FIG. 1.
Figure 3:
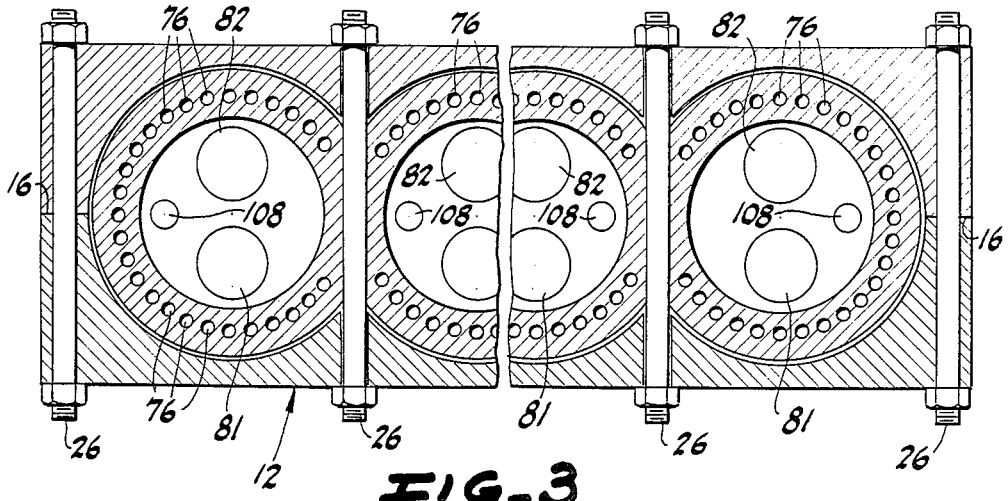
FIG. 3 is a cross-sectional view taken along the line 3—3 of FIG. 2.

Assembly, operation and use of the internal combustion engine shown in FIGS. 1–3 may now be briefly described as follows. The half sections 12*a* and 12*b* of the block 12 can be cast in the manner hereinbefore described and the V-shaped recess 47 machined therein. The unitized cylinder head and cylinder liner 41 and 42 also can be cast in the manner hereinbefore described with the necessary machining being provided on the valve seats 81 and 82 and on the V-shaped flange 51.

Thereafter, the engine can be readily assembled by placing one of the castings 12*a* and 12*b* on its side and mounting the o-ring 49 in the recess 48 and then mounting the unitized cylinder head and cylinder liner 41 and 42 with its V-shaped flange 51 in the recess. The o-rings 57 and 58 also can be mounted in the recesses in the ribs 61 so that the liner or barrel 52 engages the o-rings. Thereafter, the crankshaft 31 can be mounted in the bearings 42. Also, the connecting rods 69 can be connected to the crankshaft 31 after the pistons 66 have been inserted into the cylinder liners 42. The intake and exhaust valves 87 and 88 can be assembled in the cylinder head 41. The other half section 12*a* of the block 12 can then be mounted on top of the assembled parts which have been assembled in the other half section 12*b*. The block 12 thereafter being fastened together by the tie bolts 26 and the flange bolts 27. After assembly with the other associated parts conventionally associated with an internal combustion engine, the engine can be operated in a conventional manner.

The split block construction utilized for the internal combustion engine of the present invention has many desirable features and advantages. As can be seen, the construction as shown does not require the use of a head gasket. In addition, it makes it possible to utilize tie bolts which are isolated from the cylinder walls and therefore there is no deformation of the cylinder walls which normally is the case when head gaskets with head bolts are utilized. A particularly novel means has been utilized for securing the unitized cylinder head 41 and the cylinder liner 42 to the block 12 by the use of a cooperative clamping means which applies clamping pressures at substantially right angles to the cylinder wall and at right angles to the direction of piston movement in the vicinity of the combustion chamber. This clamping or securing means merely clamps the unitized cylinder head 41 and the cylinder liner 42 to the upper extremity of the block 12 by the use of tie bolts 26 which clamp in the cylinder head without squeezing the same. The construction shown for clamping the cylinder head 41 to the upper extremity of the block also is advantageous in that it provides adequate water circulation in the hottest parts of the block and cylinder head by the use of the plurality spaced apart circumferentially spaced holes 76 extending around the entire circumference of the cylinder head in the vicinity of the valve seats 81 and 82 to provide adequate cooling. The o-ring seal (not shown) in the recess 48 provides an adequate water-tight seal for the construction shown.

The present invention is particularly applicable to diesel engines which have greater problems with head gaskets as power is increased. The present invention also provides excellent support for the crankshafts for diesel engines.

From the foregoing it can be seen that the construction of the internal combustion engine herein disclosed by utilizing a unitized cylinder head eliminates the need for a cylinder head gasket. Splitting the cylinder block so that the parting line for the cylinder block extends in a plane which passes through the central axis of the crankshaft and axially of the crankshaft simplifies the casting for the two half sections of the block by eliminating water jacket cores. In addition, it facilitates maintenance of the desired material thickness throughout the block half sections. The construction also provides a rigid construction particularly for supporting the crankshaft. The elimination of head bolts facilitates placement of the exhaust and intake valves.

The parts of the internal combustion engine herein described can be readily cast and fabricated from conventional materials to provide relatively lightweight construction which can be readily manufactured utilizing automated equipment.

The construction herein disclosed also facilitates repair of the engine. For example, if there is a failure of a valve or a piston, it is only necessary to remove one of the unitized cylinder head and cylinder liners 41 and 42.

The tie bolts 26 which have been utilized go through the block from one side to the other. It also can be seen that two of the tie bolts are provided on each side of each main bearing for the crankshaft in order to provide two rows of such bolts. Only one other row of tie bolts 26 is provided at the lower extremity of the cylinder portion 23 of the block.

Figure 4:
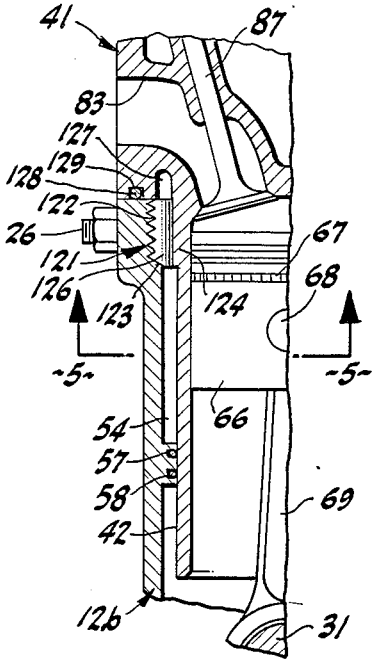
FIG. 4 is a partial cross-sectional view showing an alternative construction utilized for forming cooperative attachment means between the cylinder head and the block.
Figure 5:
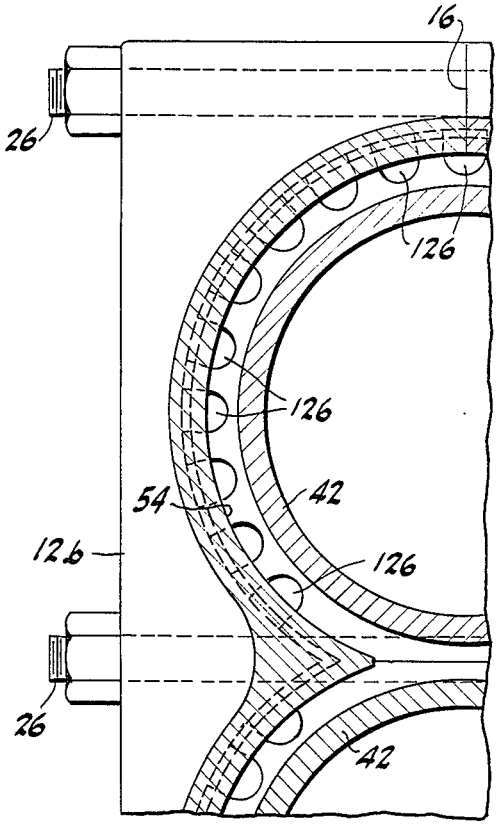
FIG. 5 is a cross-sectional view taken along the line 8—8 of FIG. 4.

Another embodiment of the invention is shown in FIGS. 4 and 5 in which alternative clamping means 121 is provided for clamping the unitized cylinder head and the cylinder liner 42. This clamping means consists of cylindrical V-shaped grooves 122 which are machined into the upper extremity of the block sections 12*a* and 12*b* so that the V-shaped grooves face inwardly and open into an imaginery cylindrical surface which is concentric with the axis of the liner or barrel 42. Cooperative V-shaped teeth or protrusions 123 are machined onto the flange 124 provided as an integral part of the cylindrical head and are formed integral with the cylinder head and cylinder liner 41 and 42. These teeth extend into the imaginery cylindrical surface which is concentric with the axis of the liner 42 and are adapted to seat within the V-shaped grooves 122 as shown particularly in FIG. 4.

A plurality of circumferentially spaced elongate slots 126 are provided in the flange 124 and open into the annular recess 54 forming the water jacket surrounding the liner 42. The slots 126 also open into annular passages 127. An O-ring 128 seated in a recess 129 provided on the bottom outer annular margin of the cylinder head 41 and serves to form a water tight seal between the cylinder head and the upper extremity of the block 12.

The operation of the engine and of this embodiment of the invention is substantially identical to that hereinbefore described.

Figure 6:
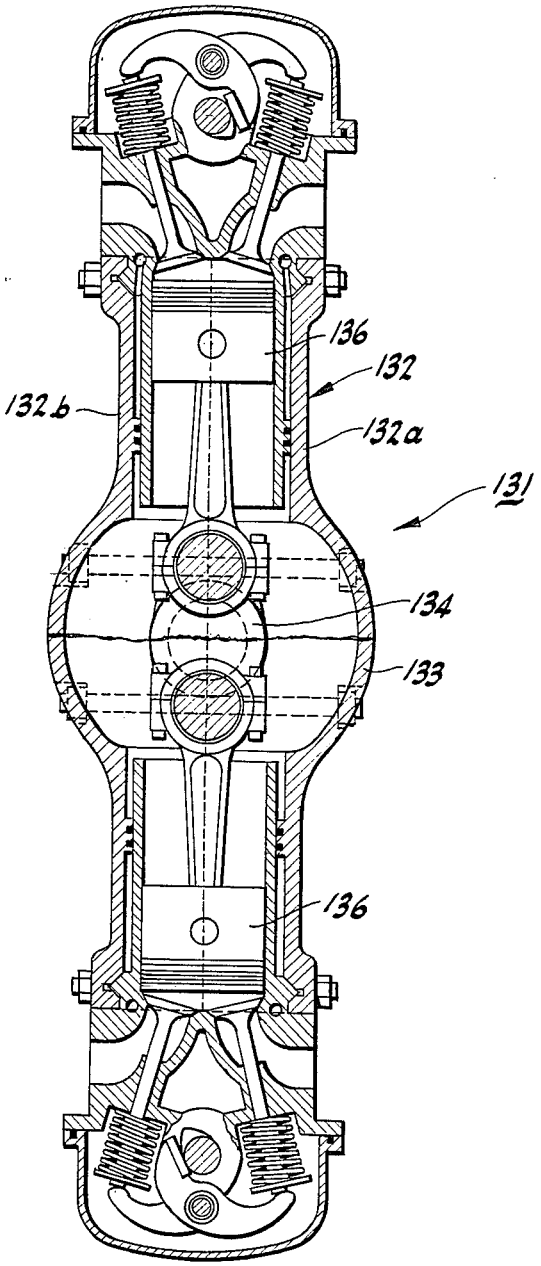
FIG. 6 is a cross-sectional view of an opposed piston multicylinder engine incorporating the present invention.

Another embodiment of the invention is shown in FIG. 6 in which a multicylinder engine 131 has been provided which has an opposed piston-type construction which is particularly adapted for certain uses as, for example, in aircraft. The engine 131 is provided with a block 132 which is formed in half sections 132*a* and 132*b*. The half sections 132*a* and 132*b* are very similar to the construction of half sections 12*a* and 12*b* shown in FIG. 1 with the exception that each of these sections 132*a* and 132*b* are constructed in such a manner that two of the half sections are provided which are joined end to end at a common crankshaft portion. A common crankshaft 134 is mounted in the block 132 and is driven by diametrically opposed pistons 136 which are reciprocably mounted in the same manner as the pistons 161 in FIG. 1.

With such an opposed cylinder construction as shown in FIG. 6, a relatively lightweight engine has been provided which is also relatively simple and rigid in construction. Water cooling provided for the cylinders provides an engine with improved efficiency.

Figure 7:
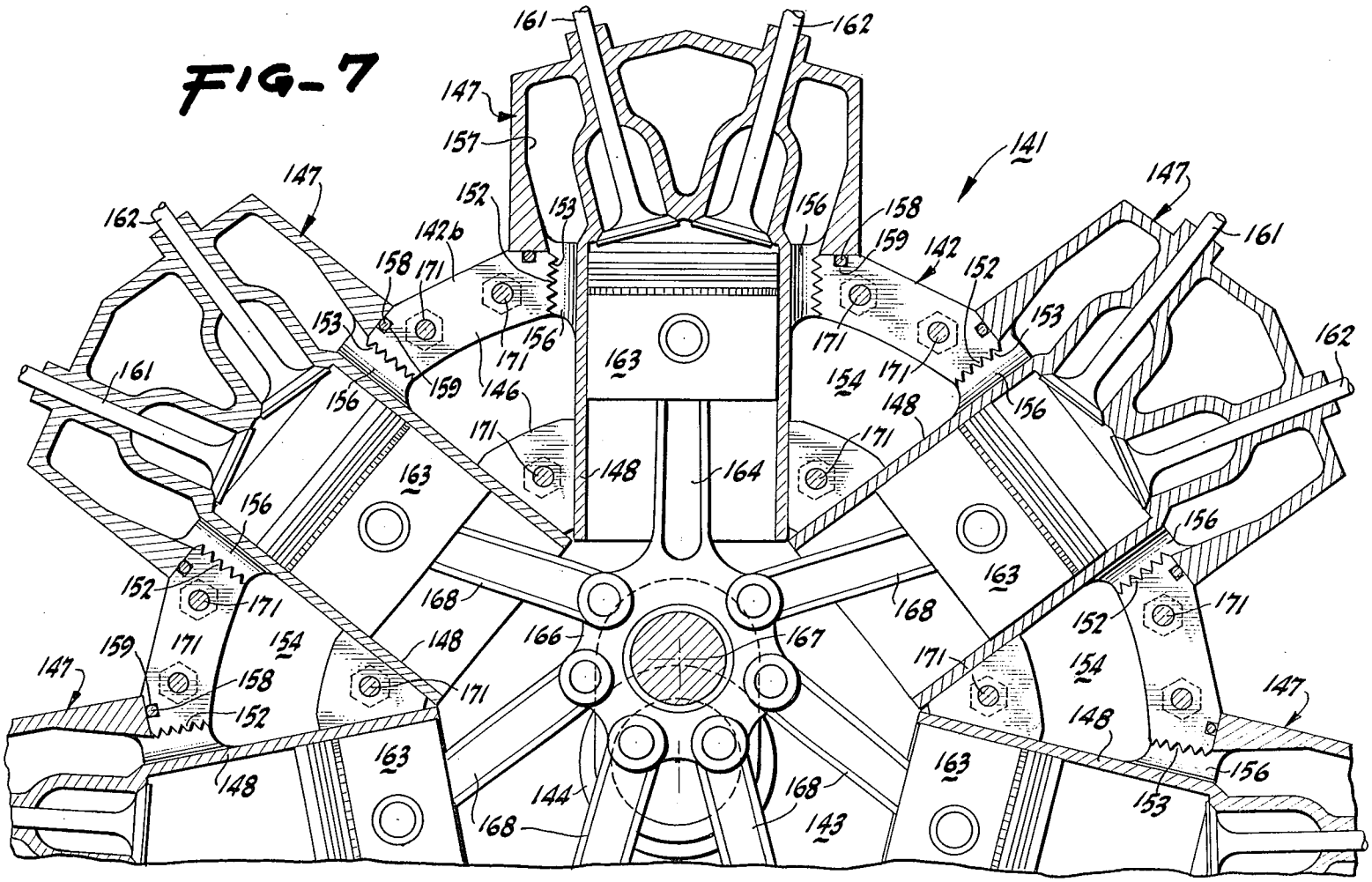
FIG. 7 is a cross-sectional view of an internal combustion engine of the radial type incorporating the present invention.

Another embodiment of the invention is shown in FIG. 7 in which a radial engine 141 is provided having a block 142 that is comprised of two sections, only one section of which is shown, section 142*b*. The sections are provided with a crankcase portion 143, a crankshaft bearing support portion 144 and a cylinder portion 146. A unitized cylinder head 147 and a barrel or sleeve 148 is provided. Clamping means 151 is provided for securing the unitized cylinder head and barrel or sleeve 147 and 148 to the engine block 142 and as shown consists of spaced apart cylindrical V-shaped recesses 152 machined into the block 142 and corresponding cooperating machined V-shaped protrusions 153 formed on the cylinder head 157. Again it can be seen that these recesses and protrusions 152 and 153 lie in planes which are generally parallel to the vertical axis of the barrel or sleeve 148.

Means is provided for liquid cooling of the block 142 and the cylinder head 147 and consists of annular passages 154 which are provided within the block. These passages communicate with a plurality of circumferentially spaced slots 156 which are in communication with annular passages 157 provided in the cylinder head 147. Suitable means is provided for forming a water-tight seal between the cylinder head 147 and the block 142 and consists of rings 158 which are seated in annular recesses 159 that are rectangular in cross section provided in the block 42 in such a manner that the o-rings face the portions of the cylinder head 147 engaging the block to provide a water-tight seal.

Intake and exhaust valves 161 and 162 are mounted in the cylinder head 147 in a manner similar to that hereinbefore described. Pistons 163 are mounted for reciprocating movement within the barrel or sleeves 148. One of the pistons 163 is connected to a master connecting rod 164 which is mounted in a fixed position on a casting 166 mounted upon a crankshaft 167. The other pistons 163 are connected by connecting links 168 to the casting 166. The split block construction has sections which are joined in a common plane which extend through the axis of the crankshaft at right angles to the axis of the crankshaft.

Tie bolts 171 have been provided for securing the half sections of the block to a unitary assembly and at the same time for securing the unitized cylinder head barrel sleeve construction 147 and 148 to the block. One row of tie bolts 171 is disposed adjacent the lower extremities of the sleeves 148 whereas other circular row of the tie bolts is provided near the upper extremities of the sleeves.

The engine hereinbefore described in conjunction with FIG. 7 particularly lends itself to aircraft applications, for example, in use in helicopters. The engine by being relatively compact and flat facilitates the distribution of cooling water throughout the engine block and the cylinder head. The construction also makes it possible to have the water exit near the exhaust valves which facilitates cooling of the exhaust valves and the spark plugs.

From the foregoing, it can be seen that a new and improved engine construction has been provided which greatly facilitates the manufacture of internal combustion engines. It makes possible improved cooling by eliminating the use of head gaskets.

What is claimed is:

1. In an internal combustion engine of the type having at least one cylinder and a crankshaft, an assembly comprised of first and second mating half sections joined in a common plane which passes through and along the axis of the crankshaft, each of said half sections providing crankcase, crankshaft bearing support, and cylinder water jacket portions, a unitized cylinder head and sleeve construction having a combustion chamber with a top surface therein and cooperative securing and sealing means for securing the unitized cylinder head and sleeve construction to the assembly in a location immediately adjacent the top surface of the combustion chamber, said cooperative securing and sealing means encircling each cylinder head and including tie bolts extending through the cylinder water jacket portions.

2. An engine as in claim 1 wherein said cooperative securing and sealing means includes at least one recess and at least one protrusion said recess opening into an imaginery cylindrical surface which is concentric with the axis of the sleeve of the unitized cylinder head and sleeve construction.

3. An engine as in claim 1 together with additional sealing means establishing a water-tight seal between the lower extremity of the cylinder head and sleeve construction and the assembly.

4. An engine as in claim 1 wherein an annular flow passage extends around the sleeve together with at least one intake valve and at least one exhaust valve and circumferentially spaced openings formed in the cylinder head and surrounding the intake and exhaust valves.

5. An engine as in claim 1 wherein said cylinder head and sleeve construction is provided with a plurality of cylinder heads and sleeves together with a crankshaft rotatably mounted in the block, a plurality of pistons disposed in the sleeves and connecting rods connecting the pistons to the crankshaft.

6. An engine as in claim 5 wherein said pistons are arranged in a common plane and wherein said common plane extends along the axis of the crankshaft.

7. An engine as in claim 5 wherein said pistons are disposed in an opposing relationship.

8. An engine as in claim 5 wherein said pistons are arranged in a radial pattern and wherein said common plane passes through the axis of the crankshaft at right angles to the axis of the crankshaft.

9. An engine as in claim 1 together with tie bolts extending through the block and securing the half sections into a unitary assembly.

* * * * *